United States Patent [19]

Hambright

[11] Patent Number: 4,655,460

[45] Date of Patent: Apr. 7, 1987

[54] GOLF PRACTICE DEVICE

[76] Inventor: Doris D. Hambright, 1510 1/2 E. Sycamore, El Segundo, Calif. 90245

[21] Appl. No.: 820,308

[22] Filed: Jan. 21, 1986

[51] Int. Cl.[4] ..... A63B 69/36

[52] U.S. Cl. ..... 273/185 C; 273/195 A

[58] Field of Search ..... 273/200 R, 195 A, 185 C, 273/196, 197 R, 197 A, 198, 199 R, 199 A, 184 B

[56] References Cited

U.S. PATENT DOCUMENTS

| | | | |
|---|---|---|---|
| 1,399,293 | 12/1921 | Craig et al. | 273/200 R |
| 2,786,683 | 3/1957 | Shapiro | 273/195 A X |
| 2,929,632 | 3/1960 | Moffatt | 273/185 C |
| 3,599,982 | 8/1971 | Elesh | 273/195 A |

FOREIGN PATENT DOCUMENTS

| | | | |
|---|---|---|---|
| 16297 | of 1909 | United Kingdom | 273/185 C |

*Primary Examiner*—George J. Marlo
*Attorney, Agent, or Firm*—Edward A. Sokolski

[57] ABSTRACT

A golf kit for practicing golf driving, pitching and chipping, employs a portable driving mat having two or more simulated turf portions having different heights, a tee, a lightweight plastic practice golf ball tethered by a string to the driving mat or to the ground by means of a pin and may additionally include a basket with an open top. The device further employs a fence hurdle formed by a plurality of spaced apart stakes with a strip of material interconnecting the top ends of the stakes which form a central fence portion and two or more fence end portions. The stakes may be supported in pedestals for use on hard surfaces or may be staked in the ground. The stakes extend a predetermined height above the floor or ground to provide an artificial fence hurdle which forms markers determining the game points. The open top basket is placed in back of the fence hurdle to provide a target. In practicing and in playing the game, the user drives the ball in an attempt to hit it over the fence. Various games points are awarded depending where the ball goes.

10 Claims, 7 Drawing Figures

GOLF PRACTICE DEVICE

This invention relates to a golf kit and game and more particularly to such a kit and game employing a fence forming a hurdle over which a lightweight simulated golf ball is driven in practicing driving, pitching and chipping.

It is often difficult for a novice golfer to drive a golf ball with proper impact, loft and aim. A number of golf practice devices have been developed in the prior art for use in teaching driving and chipping. Such devices are described for example in U.S. Pat. Nos. 2,011,014 to Rosengarten, 2,988,363 to Hall, 3,197,208 to Makar, 3,558,140 to Romeo, 3,601,406 to Giusti and 4,395,042 to Boswell. These prior art devices are directed to a golf game or training device which involves some sort of marked panel or "gate" which one drives a regular golf ball against. The use of a regular golf ball in these prior art devices obviates their use at one's home or yard particularly where a novice is involved, for obvious reasons. Further, most of the prior art devices are rather cumbersome and expensive in their construction.

The device of the present invention is a practice golf kit and game of simple construction which can be used with a high ceiling indoors, on a patio or outdoors without concern as to the danger of injury or damage from the golf ball in view of the fact that the ball employed is a practice ball made of lightweight plastic. The device of the present invention employs an artificial fence hurdle formed by a plurality of stakes which are vertically supported for use on hard surfaces by pedestals, or by staking in the ground. An artificial fence hurdle is formed between the stakes by a ribbon which interconnects the upper ends of the stakes, the stakes being arranged in a line in spaced apart relationship to form a plurality of fence sections. A driving mat is provided having simulated turf portions and a tee thereon, this mat being positioned opposite the fence at a predetermined distance therefrom. A practice golf ball which may be fabricated of a light weight plastic material is tethered on a string either to the mat or to a pin driven into the ground. A target basket may be placed in back of the fence hurdle and used for either practice or in playing the game. The user drives the ball from the mat attempting to get the ball over a selected (usually central) portion of the fence and into the basket. In playing the game, various scoring points are assigned depending on whether the ball is driven over the center or side portions of the fence, under the fence, "offsides" or into the basket.

It is therefore an object of this invention to facilitate the at-home learning of how to drive, pitch and chip a golf ball.

It is a further object of this invention to provide a practice golf device for practicing driving, pitching and chipping which can be used with high ceilings indoors or in one's patio, garage or yard with minimum risk of damage or injury.

Other objects of the invention will become apparent as the description proceeds in connection with the accompanying drawings of which:

Figure 1:
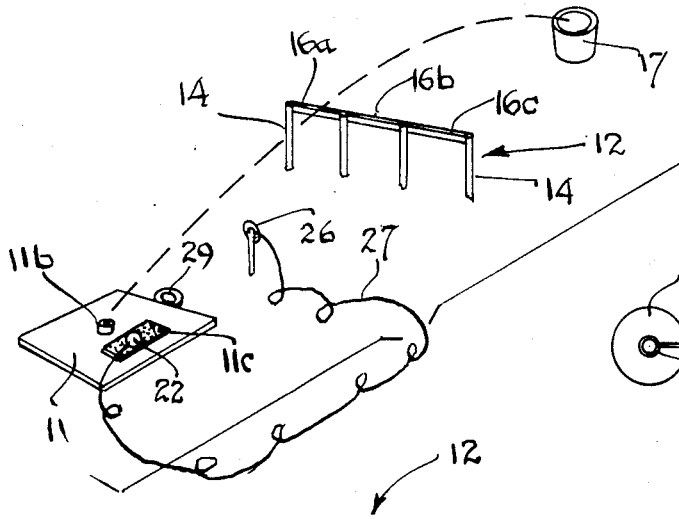
FIG. 1 is a perspective view illustrating a preferred embodiment of the invention.
Figure 3:
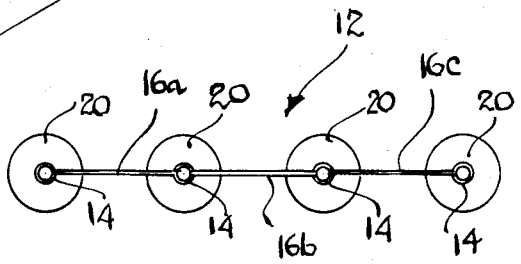
FIG. 3 is a top plan view of the fence hurdle device of FIG. 2.
Figure 2:
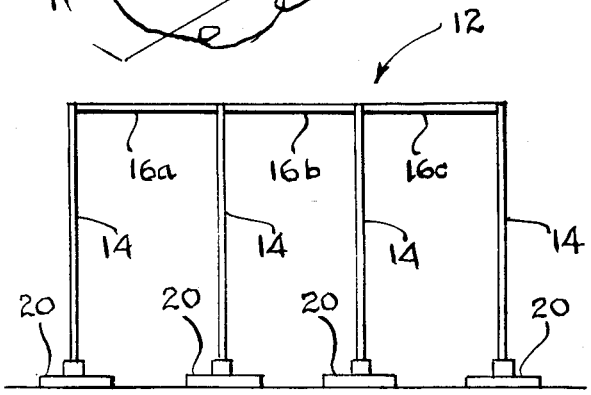
FIG. 2 is a side elevational view of a version of the fence hurdle device of the invention for use on hard surfaces.

Referring now to FIGS. 1–5, a preferred embodiment of the invention is illustrated. Driving mat 11 which may be a simulated tee-off area or fairway area of carpeted or astro turf material has a low-turf portion 11*a*, a "tee" 11*b* which may be in the form of a rubber cylindrical member simulating a golfing tee, a high-turf portion 11*c* which may be formed by brush bristles, and a higher-turf high- or low-density portion 11*d* which may be formed by other material. Spaced from driving mat 11 by a predetermined distance as may be desired for practice or game shots is fence hurdle assembly 12. This assembly, as shown in FIG. 1 set up for outdoor use, comprises a plurality of metal, plastic or wood stake members 14 which are staked in the ground and arranged in a line in spaced relationship to each other. The top ends of stake members 14 are interconnected by flexible cloth strips 16*a*–16*c*. The central strip 16*b* may be green while side strips 16*a* and 16*c* may be red to provide differentiation in scoring a game. A basket 17 is place to the rear of fence assembly 12. For indoor use or for use on a hard surface, outdoors the stakes 14 may be inserted in pedestals 20 as shown in FIGS. 2 and 3 and thus supported on a floor or hard surface.

Figure 4:
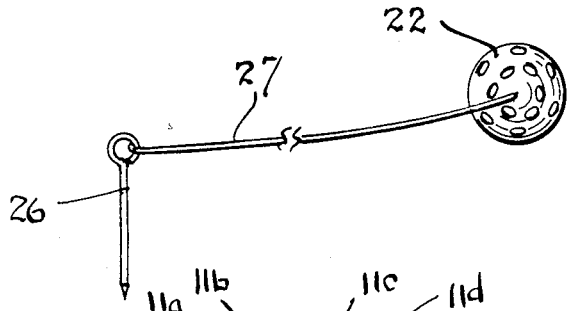
FIG. 4 is a side elevational view illustrating a simulated golf ball and tethering pin device therefore employed in the device of the invention.
Figure 6:
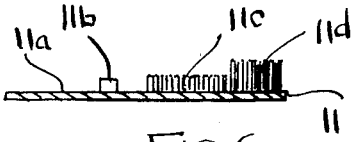
FIG. 6 is an end elevational view of the driving mat of FIG. 5.
Figure 5:
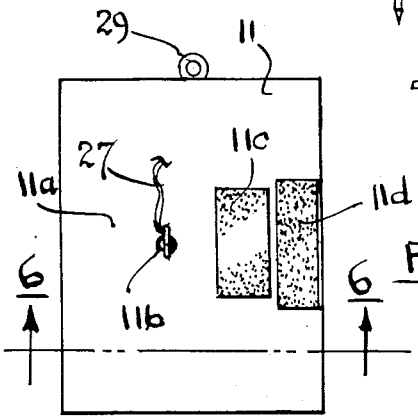
FIG. 5 is a top plan view of the driving mat of the preferrd embodiment.

As shown in FIG. 4 a simulated practice golf ball 22 of a lightweight plastic material and hollow in configuration is tethered to a loop pin 26 by means of a line 27. For outdoor use, loop pin 26 is staked in the ground as shown in FIG. 1 with a ball 22 either placed on simulated turfs 11*a*, 11*c*, 11*d*, or simulated tee 11*b*. For indoor use or for use outdoors on a hard surface, the tethering line 27 may be attached to a ring 29 attached to driving mat 11 as shown in FIG. 7.

Figure 7:
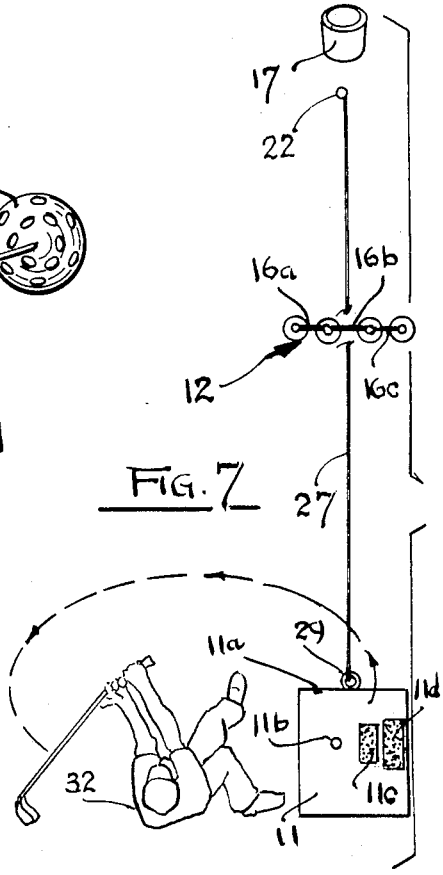
FIG. 7 illustrates the use of the device.

Referring now to FIG. 7, the use of the device is illustrated. The golfer 32 in this instance has driven the ball over the central tape 16*b* of the fence and it appears that the ball is also about to fall into basket 17. With this sort of shot, the minimum number of points would be assigned. Shots over fence portions 16*a* or 16*c* or offside would receive a larger number of points. The object as in regular golf is to score the least number of total points.

The device can be used to practice driving using simulated turf 11*c* and 11*d* to allow divoting, or the tee 11*b* may be used, or a shot may be made directly from the mat surface 11*a*. The basket 17 and the fence assembly 12 may be moved closer or further away from the mat 11 to provide a variety of practice shots. Typically, the mat 11 may be about 17 inches square with tether line 27 being about 25 feet in length. Stakes 14 may typically be 14–16 inches long with the interconnecting strips 16*a*–16*b*–16*c* each about 12 inches long.

The device of the present invention thus permits one to practice driving, pitching and chipping privately in one's own yard, patio, driveway or deck, or if the situation permits, indoors in a high ceiling garage, gym or other open space with minimum risk of causing injury or damage. Further, the device of the invention can be used in a competitive game.

While the invention has been described and illustrated in detail, it is clearly understood that this is intended by way of illustration and example only and is not to be taken by way of limitation, the spirit and scope of this invention being limited only by the terms of the following claims.

I claim:

1. A device for practicing golf driving, pitching, and chipping, comprising a portable mat having a plurality of simulated turfs and a simulated tee thereon, a simulated practice golf ball which is substantially lighter than a standard golf ball, means for tethering said ball, and fence hurdle means adapted to be spaced from said mat by a predetermined distance, said fence hurdle means being formed by a plurality of separate stake members adapted to be arranged in a line, and a plurality of separate flexible strip means for interconnecting said stake members to form a substantially linear strip running along a line which is a predetermined distance above the level of the mat.

2. The device of claim 1 wherein the means for tethering said ball comprises a line attached at one end to the ball and a staking pin attached to the other end of the line.

3. The device of claim 1 wherein the stake members each has a pedestal at one end thereof for providing upright support therefor.

4. The device of claim 1 and further comprising a basket adapted to be placed a predetermined distance behind said fence hurdle means in an upstanding position.

5. The device of claim 1 wherein the ball is hollow and of a plastic material.

6. The device of claim 1 wherein there are four stake members, the means for interconnecting said stake members comprising strips of flexible material, a strip of a first predetermined color interconnecting the two centermost stake members and strips of a second predetermined color interconnecting each of the outermost stake members and the centermost stake member.

7. The device of claim 1 wherein the means for tethering said ball comprises a line attached at one end to the ball, the other end of said line being attached to said mat.

8. A device for practicing golf driving, pitching and chipping comprising a portable mat having a first member mounted thereon simulating a high turf, a second member mounted thereon simulating a turf lower than said first member and a third member mounted thereon simulating a tee, a simulated practice golf ball which is substantially lighter than a standard golf ball, a line attached at end thereof to said ball, means for tethering the other end of the line in a substantially fixed position, and fence hurdle means adapted to be spaced from said mat by a predetermined distance, said fence hurdle means being formed by at least four separate stake members arranged in a line and a plurality of separate flexible linear strips interconnecting the stake members, said strips forming a line which runs a predetermined distance above the level of the mat.

9. The device of claim 8 wherein the flexible linear strips are of cloth, the strip interconnecting the two innermost stake members being of a first predetermined color, the strips interconnecting each of the two innermost stake members with an outer stake member being of a second predetermined color.

10. The device of claim 8 and further including a basket adapted to be placed a predetermined distance behind the said fence hurdle means in an upstanding position.

* * * * *